US006814672B2

(12) United States Patent
Spitzer

(10) Patent No.: US 6,814,672 B2
(45) **Date of Patent: *Nov. 9, 2004**

(54) GOLF POSITIONING DEVICE

(76) Inventor: Andrew Spitzer, 39 Gunners Exchange Rd., Plymouth, MA (US) 02360

( * ) Notice: Subject to any disclaimer, the term of this patent is extended or adjusted under 35 U.S.C. 154(b) by 91 days.

This patent is subject to a terminal disclaimer.

(21) Appl. No.: 09/979,219

(22) PCT Filed: Mar. 21, 2001

(86) PCT No.: PCT/US01/05824

§ 371 (c)(1),
(2), (4) Date: Nov. 21, 2001

(87) PCT Pub. No.: WO01/70344

PCT Pub. Date: Sep. 27, 2001

(65) Prior Publication Data

US 2002/0160846 A1 Oct. 31, 2002

Related U.S. Application Data

(63) Continuation-in-part of application No. 09/532,098, filed on Mar. 21, 2000, now Pat. No. 6,468,166.

(51) Int. Cl.[7] ..... A63B 69/36
(52) U.S. Cl. ..... 473/241
(58) Field of Search ..... 473/241, 404; 33/334, 373, 384, 370, 365

(56) References Cited

U.S. PATENT DOCUMENTS 3,383,772 A * 5/1968 Gardner et al. ..... 33/373
4,079,520 A * 3/1978 Davis ..... 473/241
6,468,166 B1 * 10/2002 Spitzer ..... 473/241

* cited by examiner

*Primary Examiner*—Raeann Gorden
(74) *Attorney, Agent, or Firm*—Merek, Blackmon & Voorhees, LLC

(57) ABSTRACT

A positioning device for assisting an individual in properly positioning the club face of a golf club so that a golf ball travels a desired path when struck by the golf club. The positioning device includes a hollow body, which is generally symmetrically disposed about the shaft of a golf club. The body includes an upper section and a lower section and an opening therebetween. The opening in the body receives the shaft of the golf club. The upper and lower sections each have a left and a right side. The right side of the upper section is hingedly connected to the right side of the lower section. A fastener detachably connects the left side of the upper section to the right side of the lower section. The upper section has a recess formed therein for receiving a tubular spirit. The tubular spirit is curved about the axis of the shaft of the golf club. The curve of the spirit level extends in a first plane. the first plane extends substantially perpendicular to the axis of the shaft of the golf club.

28 Claims, 5 Drawing Sheets

GOLF POSITIONING DEVICE

RELATED APPLICATIONS

The subject patent application is a national stage patent application filed under 35 USC 371 of International Patent Application No. PCT/US01/05824 having an International filing date of Mar. 21, 2001 which is a continuation in part of U.S. patent application Ser. No. 09/532,098 filed on Mar. 21, 2000, now U.S. Pat. No. 6,468,166.

FIELD OF THE INVENTION

The present invention is directed to a positioning device for aiding an individual in positioning a club relative to an object so that the object travels a desired path once struck by the club. More particularly, a preferred form of the present invention includes a positioning device which can be readily mounted on the shaft of a golf club to aid an individual in positioning the golf club relative to an intended line of flight of a golf ball so that the golf ball travels a desired path once struck by the golf club.

BACKGROUND OF THE INVENTION

Numerous training aids have been developed in an effort to assist a golfer to consistently and accurately strike a golf ball. Such training aids focus on various aspects of the game necessary for an individual to properly strike a golf ball including grip, address, swing plane and position of the club face relative to the intended line of flight. Since the present invention concerns the proper position of the club face of the golf club relative to the intended line of flight of the ball, only these type of training aids will be discussed.

Often, when striking a golf ball, an individual will take the golf club through the proper swing plane but watch dumbfounded as the golf ball travels on a path different from the intended line of flight. While several factors can be the cause of the undesired flight of the golf ball, improper position of the club face is often the cause of the golf ball straying from the intended line of flight. In order for the golf ball to travel in a straight line of flight, it is imperative that the face of the golf club be oriented perpendicular (i.e square) to the intended line of flight of the golf ball at impact. Various training aids have been developed which purport to aid the golfer in properly positioning the club face of a golf club. These include the training aids disclosed in U.S. Pat. Nos. 4,079,520 and 5,509,657.

The training aids disclosed in the aforementioned patents have numerous disadvantages. First these devices are dramatically asymmetrical relative to the shaft of the golf club. Such an orientation is undesirable for a number of reasons. The asymmetrical orientation adversely impacts the feel of the club during the swing. Specifically, the individual using this aid will likely develop an improper feel for a correct swing. This will likely result in the individual making poor golf swings, once the device is removed. Further, the asymmetrical orientation will significantly increase the torque on the training aid during the golf swing. Hence, the force necessary to properly clamp the training aid to the golf club will increase dramatically requiring a larger and more expensive clamping device. Finally, the asymmetrical orientation of these training aids are unsightly and likely to distract the golfer during his or her swing.

Another training aid is disclosed in U.S. Pat. No. 4,482,155. This training aid includes a hemispherical bubble embedded in the end of the grip of the golf club. This training aid is permanently attached to the golf club. This is undesirable because each and every club must be fitted with a similar device. Further, the location of the hemispherical bubble makes viewing difficult. Moreover, this training aid does not assist the golfer in selectively opening or closing the club face to impart a desired fade or draw on a golf ball.

Accordingly, there exists a significant need for a training aid which overcomes the aforementioned deficiencies of previously known training aids.

OBJECTS AND SUMMARY OF THE INVENTION

An object of the present invention is to provide a novel and unobvious positioning device for properly positioning the club face of a golf club so that a golf ball travels a desired flight path when struck by the golf club.

Another object of a preferred embodiment of the present invention is to provide a positioning device which can be readily positioned on the shaft of a golf club such that the positioning device is oriented generally symmetrically about the shaft of the golf club.

A further object of a preferred embodiment of the present invention is to provide a positioning device which can be readily mounted on and removed from the shaft of a golf club.

Yet a further object of a preferred embodiment of the present invention is to provide a compact and light weight positioning device which will provide a golfer with the proper orientation of the club face of a golf club.

Still a further object of a preferred embodiment of the present invention is to provide a positioning device which when mounted on the shaft of a golf club is readily observable by the golfer.

Still yet another object of the present invention is provide a positioning device which can be used in practice and in actual play.

Yet another object of the present invention is to provide a positioning device which is configured so as to minimize any distraction to the golfer during a normal swing.

Still yet another object of the present invention is to provide a positioning device which includes the necessary precision but is considerably less sensitive to vertical, horizontal and other movements of the shaft of a golf club than previously known devices and thus convenient to use.

A further object of a preferred embodiment of the present invention is to provide a positioning device which can be readily mounted on a wide variety of golf clubs.

Yet a further object of a preferred embodiment of the present invention is to provide a positioning device which can be inexpensively manufactured.

Still yet a further object of a preferred embodiment of the present invention is to provide a positioning device which will enable an individual to properly position the club face of a golf club so that the golf ball will fade, draw or travel a straight line of flight.

These and other objects of the present invention will be readily apparent upon a review of the following detailed description of the preferred form of the invention and the accompanying drawings. These objects are not exhaustive and are not to be construed as limiting the scope of the claimed invention.

In summary, a preferred embodiment of the present invention is directed to a novel and unobvious positioning device for assisting an individual in properly positioning a club face of a golf club so that a golf ball travels a desired path when struck by the golf club. The positioning device includes a hollow body which is generally symmetrically disposed about the shaft of a golf club. The body includes a front surface and a rear surface and an opening extending therebetween. The opening in the body receives the shaft of a golf club. The body further includes an upper section and a lower section each having left and right sides. The right side of the upper section is hingedly connected to the right side of the lower section. A fastener detachably connects the left side of the upper section to the left side of the lower section. The upper section has a recess formed therein for receiving a tubular spirit level. The tubular spirit level is curved about the axis of the shaft of the golf club. The curve of the spirit level extends in a first plane. The first plane extends substantially perpendicular to the axis of the golf shaft.

DETAILED DESCRIPTION OF THE INVENTION

The preferred embodiments of the present invention will now be described hereinafter with reference made to FIGS. 1 through 13.

FIGS. 1 Through 8

Figure 1:
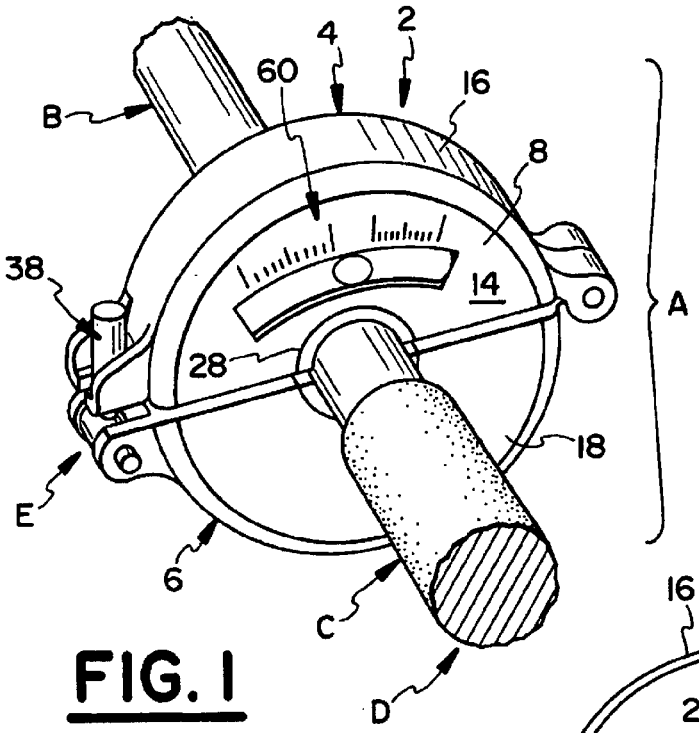
FIG. 1 is a front perspective view of a preferred embodiment of the present invention mounted on the shaft of a golf club.
Figure 3:
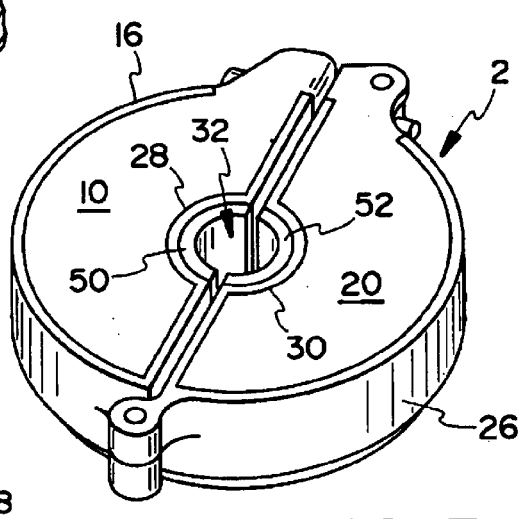
FIG. 3 is a rear perspective view of the preferred embodiment of the present invention removed from a golf club.
Figure 2:
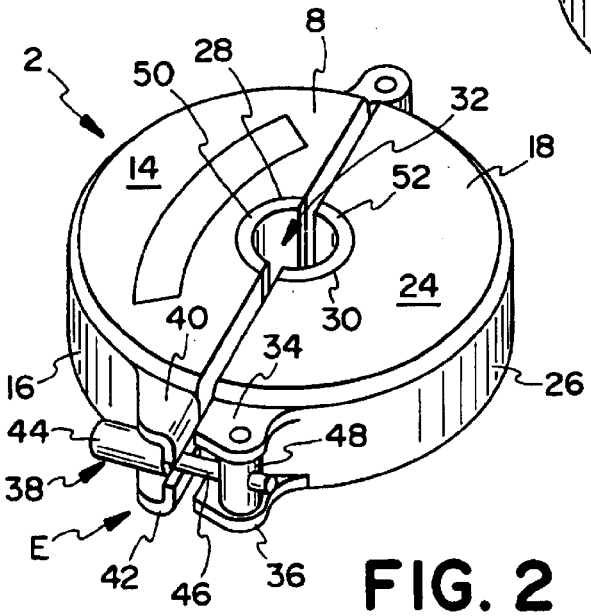
FIG. 2 is a front perspective view of the preferred embodiment of the present invention removed from a golf club.

The preferred embodiment of the present invention will now be described with reference to FIGS. 1 through 8. Referring to FIGS. 1 through 3, the positioning device A is preferably mounted on the shaft B immediately below the grip C of golf club D (only a portion of which is shown). This position of device A is advantageous because it allows for convenient viewing by the golfer. However, it will be readily appreciated that the position of the device A may be varied to meet the needs of specific golfers. The positioning device A is generally symmetrically oriented relative to the axis of the shaft B. This orientation reduces the impact of the body 2 on the feel of the club during a normal swing. Further, the torque generated by the body 2 during a normal swing is significantly reduced thus lowering the clamping force necessary to clamp the body 2 to the shaft B. Moreover, this orientation minimizes the distraction body 2 presents to a golfer at address as well as during a normal swing.

Figure 6:
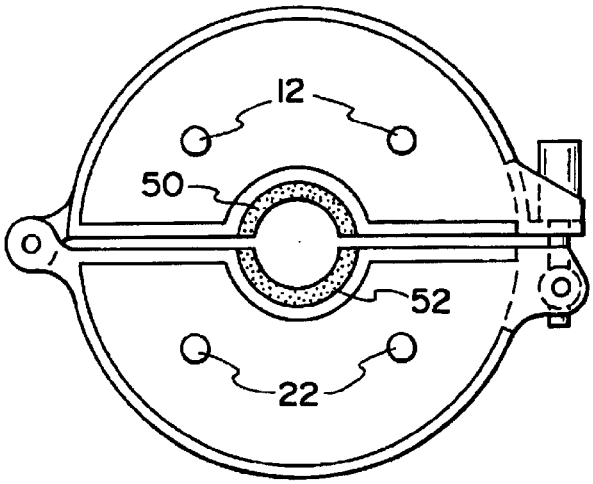
FIG. 6 is a rear view of the preferred embodiment of the present invention.
Figure 7:
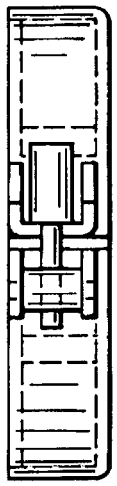
FIG. 7 is a left side view of the preferred embodiment of the present invention.
Figure 8:
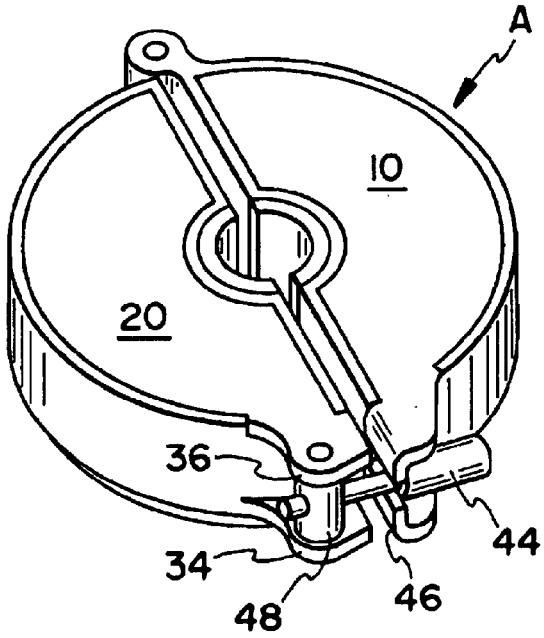
FIG. 8 is a rear perspective view of the preferred embodiment of the present invention.

The positioning device A includes a body 2. Preferably, the body 2 is hollow and made of a light weight material (e.g. a light weight plastic). The body 2 includes an upper section 4 and a lower section 6. The upper section 4 includes a cover 8 and a back plate 10, as seen in FIG. 6. A pair of screws 12 secure the cover 8 to the back plate 10. The cover includes a front face or surface 14 and a skirt 16 which extends along the outer periphery of the front face 14. The lower section 6 includes a cover 18 and a back plate 20. A pair of screws 22 secure the cover 18 to the back plate 20, as seen in FIG. 6. The cover 8 includes a front face or surface 24 and a skirt 26 which extends along the outer periphery of the front face 24. The upper section 4 includes an arcuate portion 28. Similarly, the lower section 6 includes an arcuate portion 30. Arcuate portions 28 and 30 form an opening 32 extending completely through the body 2. Opening 32 receives the shaft of a golf club.

The upper section 4 and the lower section 6 each include left and right sides. The right side of the upper section 4 is hingedly connected to the right side of the lower section 6. Fastener E detachably connects the left side of the upper section 4 to the left side of the lower section 6. The fastener E includes a pivot arms 34 and 36. Preferably, pivot arm 34 is formed as one-piece with cover 18 and pivot arm 36 is formed as one-piece with the back plate 20. The pivot arms 34 and 36 permit clamping element 38 to pivot between the full line position and the dotted line position shown in FIG. 4. The fastener E further includes clamping arms 40 and 42. Preferably, clamping arm 40 is formed as one-piece with cover 8 and clamping arm 42 is formed as one-piece with the back plate 10. When the clamping element 38 is in the dotted line position shown in FIG. 4, the body 2 may be attached to or removed from the shaft of a golf club. The clamping element 38 includes a head 44, a shaft 46 and a cylinder 48. It will be appreciated by those of ordinary skill in the art that the clamping element 38 may be designed such that the distance between the head 44 and the cylinder 48 may be varied so that the positioning device may be placed on shafts of varying diameters. When the clamping element 38 is in the full line position shown in FIG. 4, the body 2 is secured to the shaft of the golf club. It will be readily appreciated that numerous other fasteners may be used to secure the body 2 to the shaft of a golf club.

Figure 4:
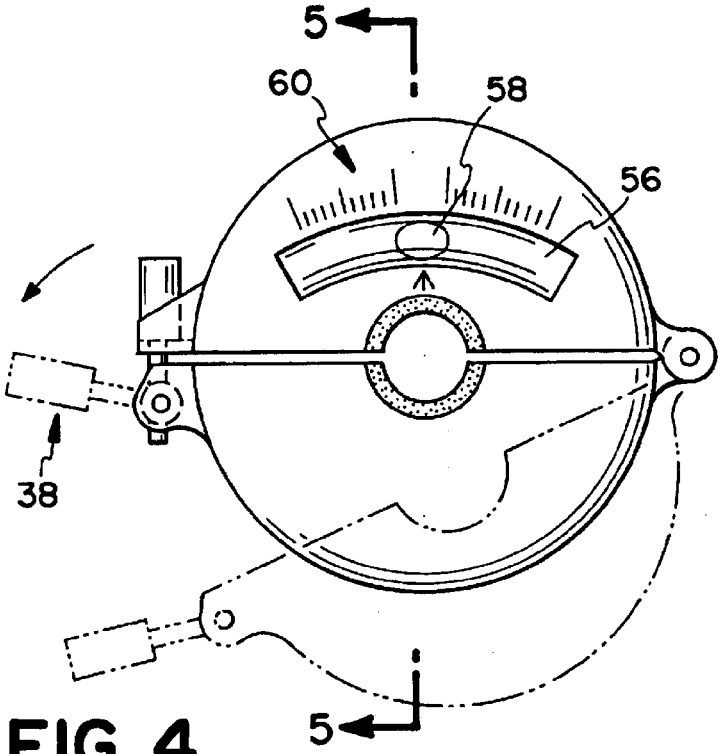
FIG. 4 is a front view of the preferred embodiment of the present invention.
Figure 5:
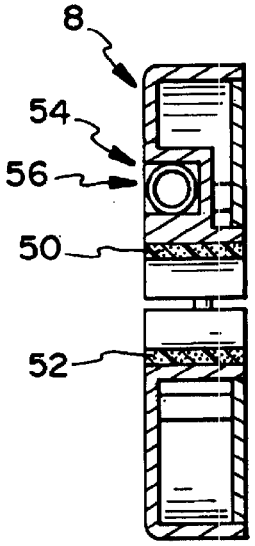
FIG. 5 is a cross-sectional view taken along lines 5—5 of FIG. 4.

Referring to FIGS. 4 to 6, strips 50 and 52 of double sided tape are attached at one side to the arcuate portions 28 and 30, respectively, and at the other side to the corresponding portion of the shaft of the golf club to prevent the positioning device A from rotating, sliding or slipping on the shaft of the golf club. While double sided tape is preferred it will be readily appreciated that various other means may be employed to ensure that the body 2 does not rotate, slip or slide relative to the shaft of a golf club.

Referring to FIG. 5, a recess 54 is formed in the cover 8 of the upper section 4. A tubular spirit level 56 is force fit, cemented or otherwise secured in recess 54. The spirit level 56 is curved about the axis of the golf shaft. Further, as seen in FIG. 1, the curve of the spirit level 56 extends in a plane which is perpendicular to the axis of the shaft B. The spirit level 56 is a sealed tube containing a liquid and an air bubble 58, as seen n FIGS. 1 and 4. Indicia 60 is formed above the recess 54. Also, indicia such as an arrow in the center of the spirit level 56 may be provided below the spirit level 56. Providing a tubular spirit level curved about the axis of the shaft reduces the sensitivity of the spirit level thus enabling a golfer to readily align the air bubble so that the golf ball travels a desired path. Usually, this can be done in one or two seconds. This is an important consideration when the device A is being used in a round of golf. Further, the orientation of the spirit level in a plane perpendicular to the axis of the shaft B results in a relatively constant and direct movement of the air bubble upon rotation of the shaft B. This aspect is especially beneficial for more advanced players in selecting the proper position of the golf club to impart a desired fade or draw on the golf ball.

FIGS. 9 Through 13

The use of the positioning device will now be described with reference made to FIGS. 9 through 13.

Figure 11:
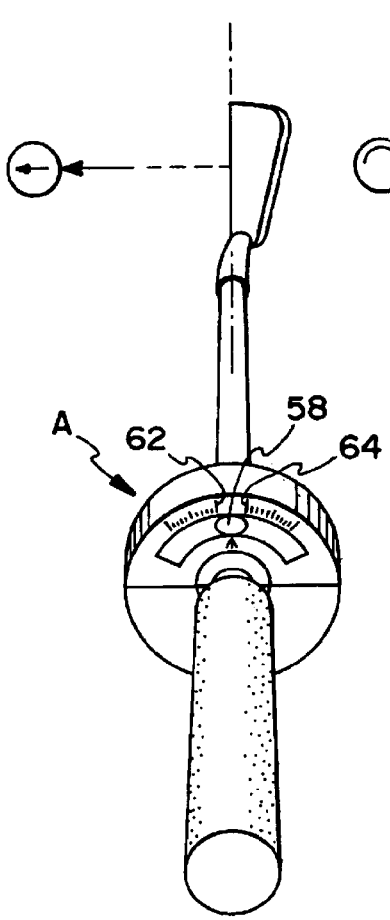
FIG. 11 is a top perspective view of a golf club with the positioning device of the present invention mounted thereon with the club face oriented such that the golf ball will travel on a straight line of flight.
Figure 12:
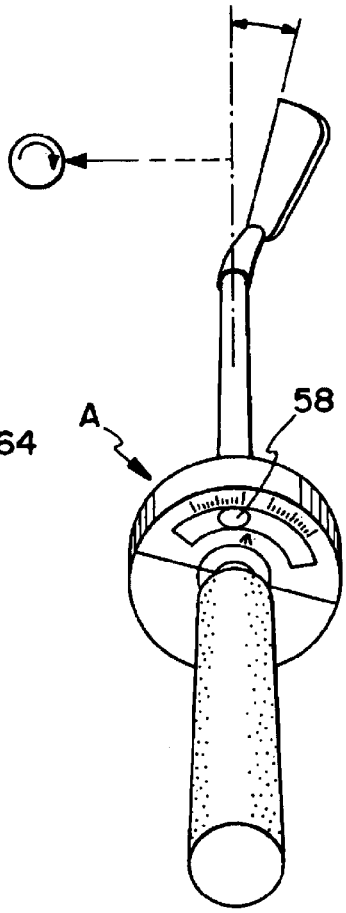
FIG. 12 is a top perspective view of a golf club with the positioning device of the present invention mounted thereon with the club face oriented such that the golf ball will fade or slice.
Figure 13:
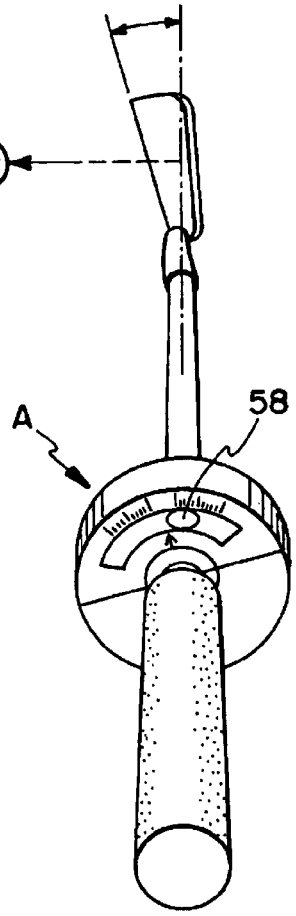
FIG. 13 is a top perspective view of a golf club with the positioning device of the present invention mounted thereon with the club face oriented such that the golf ball will draw or hook.

The most important angular relationship in order for a golf ball to travel on a desired path is the angular relationship between the club face and the intended line of flight. This relationship is illustrated in FIGS. 11 to 13. FIG. 11, illustrates the proper angular relationship between the club face and the intended line of flight of the golf ball so that the golf ball travels on a straight line of flight. As illustrated in FIG. 11, the club face forms a ninety degree angle with the intended line of flight. The air bubble 58 is oriented between the lines 62 and 64 when the club face is at a ninety degree angle to the intended line of flight of the golf ball Hence, a golfer can readily position the club face at a desired orientation by merely turning the club shaft until the air bubble 58 is between lines 62 and 64.

FIG. 12, illustrates the angular relationship between the club face and the intended line of flight to impart the necessary spin on the golf ball in order for the golf ball to fade. As is readily evident from FIG. 12, the angle between the club face and the intended line of flight is greater than ninety degrees. The greater the angle, the more dramatic the fade. A golfer may use the positioning device to more consistently determine the position of the club face relative to the intended line of flight of the ball to achieve the desired amount of fade on the golf ball.

FIG. 13, illustrates the angular relationship between the club face and the intended line of flight to impart the necessary spin on the golf ball in order for the golf ball to draw. As is readily evident from FIG. 13, the angle between the club face and the intended line of flight is less than ninety degrees. The less the angle, the more dramatic the draw. A golfer may use the positioning device A to more consistently determine the position of the club face relative to the intended line of flight of the ball to achieve the desired amount of draw on the golf ball.

Installation is a relatively easy but important procedure to ensure maximum benefits of the present invention. Due to differences in the way golfers set up to hit a golf ball, the device must be set up specifically for the golfer who is to use the device. Such golfer uses reference marks on the ground to align the club face perpendicular to the intended line of flight. The device is then attached with the bubble centered between the reference marks 62 and 64, as seen in FIG. 11.

Figure 9:
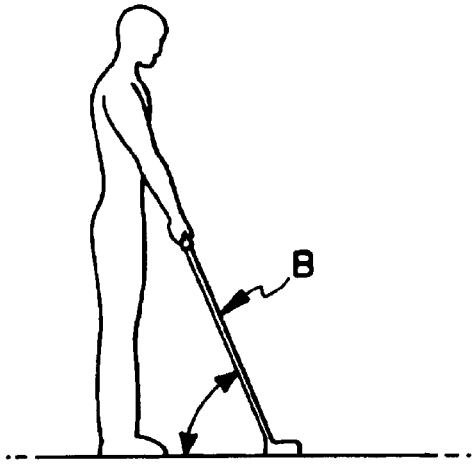
FIG. 9 is a side view illustrating the angle between the club shaft and the ground.
Figure 10:
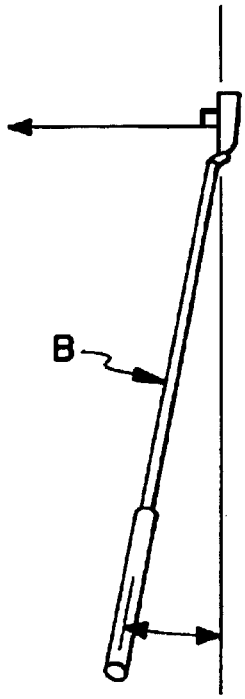
FIG. 10 is a top view illustrating the angle between the shaft of the golf club and the club face when the club face is oriented at a ninety degree angle to the intended line of flight of the golf ball.

FIG. 10 illustrates the position of the golf shaft when the hands of the golfer are not directly in line with the golf ball. The present invention can readily accommodate this position of the golfers hands. However, it must be kept in mind that if the position of the golfers hands relative to the golf ball is varied, the device A must be reset for each varied position. FIG. 9 illustrates the angle formed between the shaft and the ground. It is important to note that changing this angle does not affect the proper functioning of positioning device A.

FIG. 14

Figure 14:
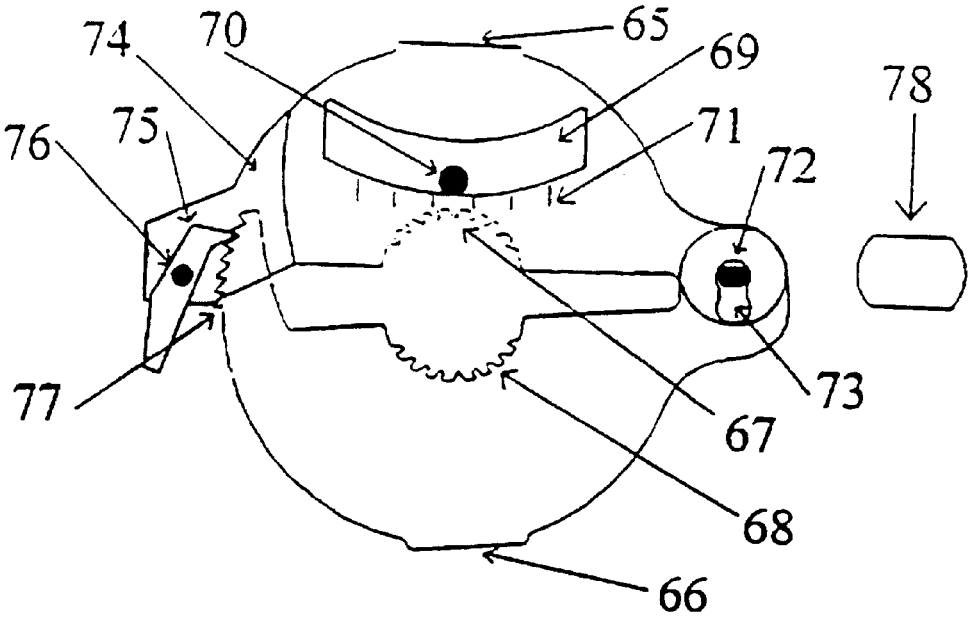
FIG. 14 is a front elevational view of an alternative embodiment of the present invention removed from a golf club.

FIG. 14 shows alternatives to the preferred embodiment of the present invention. Flat areas 65 and 66 are added to both halves of the body to limit twisting of the device when it is secured to the shaft of a golf club. An alternative to the two-sided tape (50 and 52 of FIG. 6) used to prevent relative movement between the positioning device and the shaft of a golf club is to mount the positioning device on the lower part of the golf club grip and add teeth 67 and 68 on the vertical walls of the opening for the shaft.

An alternative to the spirit level used in the preferred embodiment, is an indicator that uses gravity instead of floatation to determine true vertical. A sealed chamber 69 having a curved working surface and a material 70 that freely operates based on gravity against such curved working surface is substituted for the spirit level found in the preferred embodiment. A ball or fluid metal would function as the material 70. The chamber may also contain a fluid substance to stabilize or dampen the movement of said material. Alternative indicia 71 are added on the body of the positioning device for orienting the material 70. Given that this alternative device works based on gravity instead of floatation, as in the preferred embodiment, the orientation of the curve of the chamber is the vertical inverse of that used for the spirit level in the preferred embodiment. Wherein, the nadir of the curve is the point closest to the shaft axis of the golf club and all points on the working surface of the curve of an equal distance on either side of that nadir are an equal distance from the shaft axis. Lastly, for the same reasons as explained in the preferred embodiment, the device works best when the curve also lies on a plane that is perpendicular to the axis of the shaft of the golf club.

An alternative to the traditional hinge used in the preferred embodiment is to use a slip joint hinge that requires special pin 72 (magnified 78) that is secured in the top half of the body. This pin 72 operates within an hourglass opening 73 in the bottom half of body. This alternative hinge has been incorporated into the design of utility pliers. It is beneficial to the present invention because it increases the number of shaft sizes the device will fit on. To adjust between the two settings you just rotate the top half of the body 90 degrees and slide it up or down depending on what setting is required.

One of many alternatives to the fastening mechanism used in the preferred embodiment for securing the top and bottom halves of the body to the shaft of a golf club is the ratcheting mechanism depicted by reference numerals 74–77. Material 74 extends from the back surface of the top half of the body and a buckle 75 is secured to it with rivet 76. The buckle 75 rotates on rivet 76 with a torsion spring (not depicted)

applying clockwise force. A toothed extension 77 from the bottom half of body operates in a ratcheting fashion against buckle 75 thereby providing multiple settings for securing the body of the device to various golf club shaft sizes. This alternative to the fastening mechanism used in the preferred embodiment has been used for in-line skates and ski boots.

FIG. 15

Figure 15:
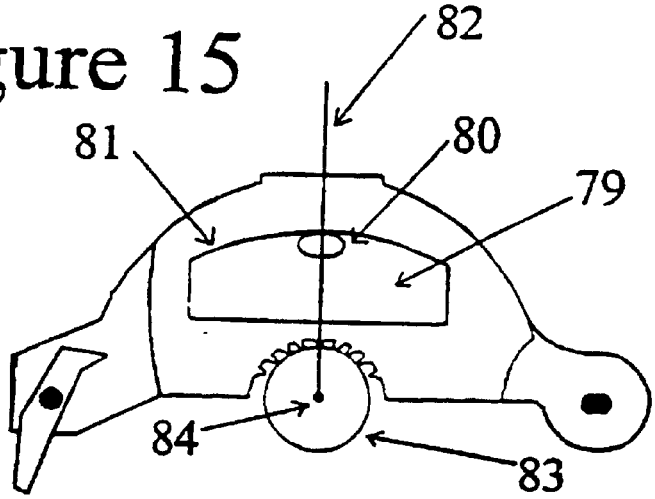
FIG. 15 is a front fragmentary elevational view of an alternative to the tubular spirit level used in the preferred embodiment.

FIG. 15 illustrates one of many possible alternatives to the curved tubular spirit level described in the preferred embodiment. It includes a sealed chamber 79 containing a fluid and a float means 80 operatively associated with said fluid for indicating true vertical 82. The sealed chamber 79 can be any shape as long as the working surface 81 operating against float means 80 is curved. The float means 80 can be any material or gas that is less dense than the fluid contained in the chamber. Although a gas bubble is preferred, a light material such as cork or plastic would function satisfactorily. The curved surface 81 of the sealed chamber 79 is oriented about the axis 84 of the shaft 83 of a golf club received in the opening of the body of the positioning device.

While this invention has been described as having a preferred design, it is understood that it is capable of further modifications, uses and/or adaptations following in general the principle of the invention and including such departures from the present disclosure as come within the known or customary practice in the art to which the invention pertains and as may be applied to the central features hereinbefore set forth, and fall within the scope of the invention and the limits of the appended claims.

I claim:

1. A positioning device for aiding an individual in positioning a club face of a golf club relative to an intended line of flight of a golf ball so that the golf ball travels a desired path once struck by the golf club; said positioning device comprising:

(a) a body having an opening for receiving a shaft of a golf club; and, (b) an indicator for indicating the proper position of the club face of a golf club relative to an intended line of flight of a golf ball so that the golf ball travels a desired path once struck by the golf club, said indicator being disposed in said body such that said indicator is visible, said indicator comprising a transparent chamber having a curved working surface and a material enclosed in said chamber that operates freely based on gravity against said curved working surface for the purpose of finding true vertical, said curved working surface of said chamber is oriented such that the nadir of said curved working surface is the point on the curve closest to an axis of the shaft of a golf club received in said opening of said body, all points on said curved working surface of equal distance on either side of said nadir are substantially of equal distance from the axis of the shaft of the golf club.

2. The positioning device set forth in claim 1, wherein:

(a) said positioning device is substantially symmetrically disposed about the shaft of a golf club received in said opening of said body.

3. The positioning device set forth in claim 1, wherein:

(a) said body has a recess formed therein for receiving said indicator.

4. The positioning device set forth in claim 1, wherein:

(a) said transparent chamber is sealed and contains a fluid for dampening the movement of said material enclosed in said chamber.

5. The positioning device set forth in claim 1, further includes:

(a) indicia on said positioning device for indicating the proper position of said material in said chamber so that a golf ball travels a desired path.

6. The positioning device set forth in claim 5, wherein:

(a) said indicia includes reference marks for identifying the position of said material in said chamber where the club face of the golf club is perpendicular to the intended line of flight; and, (b) said indicia includes additional reference markings for identifying positions of said material in said chamber where the club face is positioned other than perpendicular to the intended line of flight so that the golf ball travels a non-linear path once struck by the club face.

7. The positioning device as set forth in claim 1, wherein:

(a) said body includes first and second sections, said opening of said body being formed by said first and second sections; and, (b) means for securing said first section to said second section to prevent relative movement between said body and the shaft of the golf club, said means including multiple settings to allow for varying golf club shaft sizes.

8. The positioning device set forth in claim 1, wherein:

(a) said curved working surface of said transparent chamber extends in a first plane, said first plane being substantially transversely disposed relative to the axis of the shaft of a golf club received in said opening of said body.

9. The positioning device set forth in claim 7, wherein:

(a) said first and second sections each having left and right sides, one of said left and right sides of said first section being hingedly connected to a corresponding left and right side of said second section; and, (b) said body including a fastener for detachably connecting the other of said left and right sides of said first section to the corresponding other of said left and right sides of said second section so that said body can be readily mounted on and removed from a shaft of a golf club.

10. The positioning device set forth in claim 1, wherein:

(a) said opening in said body includes a friction means for creating added friction between said opening and the shaft of a golf club received in said opening.

11. A positioning device for aiding an individual in positioning the club face of a golf club relative to an intended line of flight of a golf ball so that the golf ball travels a desired path once struck by the golf club; said positioning device comprising:

(a) a body having an opening for receiving the shaft of a golf club; and, (b) an indicator for indicating the proper position of the club face of a golf club relative to an intended line of flight of a golf ball so that the golf ball travels a desired path once struck by the golf club, said indicator being disposed in said body such that said indicator is visible, said indicator having a sealed transparent chamber containing a fluid and a float operatively associated with said fluid for indicating true vertical, said sealed transparent chamber having a curved surface for operation with said float, said curved surface being oriented about the axis of the shaft of a golf club received in said opening of said body, said curved surface of said sealed transparent chamber extends in a first plane, said first plane being substantially transversely disposed relative to the axis of the shaft of a golf club received in said opening of said body.

12. The positioning device set forth in claim 11, wherein:

(a) said positioning device is substantially symmetrically disposed about the axis of the shaft of a golf club received in said opening of said body.

13. The positioning device set forth in claim 11, wherein:

(a) said body has a recess formed therein for receiving said indicator.

14. The positioning device set forth in claim 13, wherein:

(a) said float of said indicator is a gas bubble.

15. The positioning device set forth in claim 13, wherein:

(a) said sealed chamber is a sealed tube having a circular cross-section.

16. The positioning device set forth in claim 11, wherein:

(a) said opening in said body includes a friction means for creating added friction between said opening and the shaft of a golf club received in said opening.

17. A positioning device set forth in claim 11, wherein:

(a) said body includes a first section and a second section, said first and second sections each having left and right sides, one of said left and right sides of said first section being hingedly connected to a corresponding left and right side of said second section; and, (b) said body including a fastener for detachably connecting the other of said left and right sides of said first section to the corresponding other of said left and right sides of said second section so that said body can be readily mounted on and removed from a shaft of a golf club.

18. A positioning device for aiding an individual in positioning a club face of a golf club relative to an intended line of flight so that a golf ball travels a desired path once struck by the golf club, said positioning device comprising:

(a) a body having an opening for receiving the grip portion of the shaft of a golf club, and (b) a friction means for creating added friction between said opening in said body and the grip portion of the shaft of the golf club; and (c) an indicator for indicating the proper position of a club face of a golf club relative to the intended line of flight so that a golf ball travels a desired path once struck by the golf club, said indicator being disposed in said body such that said indicator is visible, said indicator comprising a sealed transparent chamber containing a fluid and a float operatively associated with said fluid for indicating true vertical, said sealed transparent chamber has a curved surface for operation with said float, said curved surface being oriented about the axis of the shaft of the golf club, said sealed transparent chamber being shaped and oriented to operate on more than one of the different lie angles corresponding to the various clubs without realignment of said sealed transparent chamber relative to said body.

19. The positioning device set forth in claim 18, further includes:

(a) indicia on said positioning device for orienting said float, whereby a golfer positions himself so as to hit a golf ball along a desired line of flight and rotates the shaft of the golf club until said float is in proper relation with said indicia, thereby orienting the club face of the golf club in a desired position so that the golf ball travels a desired line of flight.

20. The positioning device set forth in claim 18, wherein:

(a) said friction means comprises teeth on the vertical walls of said opening in said body.

21. The positioning device set forth in claim 18, wherein:

(a) said positioning device is substantially symmetrically disposed about the axis of the shaft of a golf club received in said opening of said body.

22. The positioning device as set forth in claim 18, wherein:

(a) said body has a recess formed therein for receiving said sealed transparent chamber.

23. The positioning device set forth in claim 19, wherein:

(a) said indicia includes reference marks for identifying the position of said float so that the club face of the golf club will be perpendicular to the intended line of flight.

24. The positioning device set forth in claim 23, wherein:

(a) said indicia includes further markings for identifying various positions of said float where the club face is positioned other than perpendicular to the intended line of flight of the golf ball so that the golf ball travels a non-linear path once struck by the club face.

25. The positioning device as set forth in claim 18, wherein:

(a) said float is a gas bubble.

26. The positioning device as set forth in claim 18, wherein:

(a) said body includes first and second sections, said opening of said body being formed by said first and second sections; and, (b) means for securing said first section to said second section to prevent relative movement between said body and the shaft of the golf club, said means including multiple settings to allow for varying club shaft sizes.

27. The positioning device as set forth in claim 26; wherein:

(a) said first and second sections each have left and right sides, one of said left and right sides of said first section is hingedly connected to a corresponding left and right side of said second section; and, (b) said body includes a fastener for detachably connecting the other of said left and right sides of said first section to the corresponding other of said left and right sides of said second section so that the body can be readily mounted on and removed from the shaft of a golf club.

28. The positioning device as set forth in claim 18 wherein: said curved surface of said indicator chamber extends in a first plane, said first plane is substantially a transverse plane of the axis of the shaft of the golf club.

* * * * *